United States Patent [19]

Gold

[11] Patent Number: 4,852,757

[45] Date of Patent: Aug. 1, 1989

[54] ADAPTER FOR EXPANDING THE VOLUME OF A CONTAINER

[76] Inventor: Milton Gold, 620 Longview Ave., South Orange, N.J. 07079

[21] Appl. No.: 184,367

[22] Filed: Apr. 21, 1988

[51] Int. Cl.[4] ..... B65D 25/00

[52] U.S. Cl. ..... 220/4 A; 220/90.6

[58] Field of Search ..... 220/4 A, 4 C, 90.2, 220/90.4, 90.6, 355, 358

[56] References Cited

U.S. PATENT DOCUMENTS

| | | | |
|---|---|---|---|
| 2,545,577 | 3/1951 | Griffin | 220/4 A |
| 2,782,614 | 2/1957 | Currie | 220/90.6 |
| 2,873,881 | 2/1959 | Nichols | 220/4 A X |
| 4,717,037 | 1/1988 | van der Meulen | 220/90.6 |

*Primary Examiner*—Steven M. Pollard

*Attorney, Agent, or Firm*—Lerner, David, Littenberg, Krumholz & Mentlik

[57] ABSTRACT

A container having a standard storage space is operatively associated with an adapter having a connecting means thereon to permit the adapter to be connected on the container so that in assembled position the adapter will expand the size and volumetric capacity of the storage space of the container a predetermined amount. The adapter is essentially a shaped annular member which defines an auxiliary storage space of predetermined volumetric capacity has a connecting means made from material having a memory which is formed on the inner surface to enable the adapter to be mounted about the open end of the standard storage space to add thereto the predetermined volumetric capacity of the auxiliary storage space when the adapter is in assembled position on the container. The connecting means is shaped and sized to fit the end of the container or an associated adapter and by reason of the material also can be sized with a width less than the width of the adjacent end of the container to which the adapter is connected so that a friction fit is established when the adapter is snapped into assembled position on the container. A seal in the connecting means provides a fluid tight joint when the adapter means is in assembled position.

6 Claims, 4 Drawing Sheets

ADAPTER FOR EXPANDING THE VOLUME OF A CONTAINER

BACKGROUND OF THE INVENTION

This invention relates generally to containers for various uses and ore particularly to a container and an associated adapter or adapters so connectable that the volumetric capacity of the container can be easily modified, to simplify, facilitate, and reduce the cost of manufacturing a range of containers having sizes and volumetric capacities respectively intermediate the generally standard sizes of containers conventionally manufactured, so the same will be readily available to customers without the need of customizing the manufacture of such intermediate sizes.

Manufacturers in order to manufacture and sell containers in the commercial marketplace at competitive prices, establish fabrication machinery and processes which enable manufacture of the containers to be fixed in a generally standard range of sizes and volumetric capacities, thus reducing the cost of manufacture.

Invariably however there are customers who require containers with volumetric capacities which are intermediate or greater than that of the standard range of sizes and volumetric capacities of the containers manufactured and sold by the manufacturer. In order to meet such requirements of the customer it is necessary to modify the fabrication machinery and processes to provide the customized container in accordance with the specifications of the customer. It will be obvious to those skilled in the art that whenever such change in the manufacturing procedures becomes necessary the cost and the price of such customized containers increases materially.

When used in this application, the term—generally standard range of sizes and volumetric capacities—or words similar thereto, applicant means either the standards set by the manufacturers, by the trade in a given industry, by Administrative Organizations for Engineers and Industries, and the like agencies utilized to reduce cost, waste, and other factors relating to the manufacture of all types of products and systems.

Various efforts have been made in the prior art to provide containers which are capable of varying or changing volumetric capacity, as is shown by U.S. Pat. Nos. 2,256,865; 2,625,044; 2,690,080; 2,839,928; 3,134,264, and 4,624,382.

U.S. Pat. No. 3,134,264 is particularly noted because it utilizes a series of wall extensions which are superimposed or removed selectively and alternatively on a measuring cup base unit having a given volumetric capacity to alter or vary the volumetric capacity of the base unit of the measuring cup as may be required. This is accomplished by modifying the upper edge or rim of the base and the associated end edges of the wall extensions so the wall extensions can be brought into threaded and sealing engagement when in assembled position. This construction is costly to manufacture and treats only with an enabling arrangement for a measuring cup rather than the broad problem of providing a simple, economical and easily adaptable means for changing the volumetric capacity needed in the manufacture of commercial containers.

The present invention seeks to meet this problem by providing an improved adapter or adapters which can be superimposed and removed selectively and alternatively on a generally standard size container to enable the volumetric capacity of the said generally standard sized containers to be easily varied to meet the needs of customers having requirements for volumetric capacity which differ from those of the standard size containers conventionally manufactured.

The improved adapters for overcoming this problem are particularized by having one end shaped with the same type of outer bead element provided on the ends of conventional containers for strength and other practical reasons and at the opposite end suitable wall means which defines a connecting means or assembly having a sized cavity with a width slightly less than the thickness of the walls of the upper beaded ends of the container on which the adapter will be fitted, the container means shaped with an internal groove so positioned as to match and mate with the upper beaded end of the container or an associated adapter during assembly of the adapter onto the container or such associated adapter, the adapter or the wall means defining the connecting means or assembly being made of a material having a memory and therefore sufficiently deformable or resilient to cause the adapter to snap into engagement with the bead and wall of the container or coacting adapter during assembly so that the elements of the expanded container are securely fastened to each other.

Further the connecting means on the respective adapter is provided with a suitable seal in the cavity to form a fluid tight joint when the elements are in assembled position.

SUMMARY AND OBJECTS OF THE INVENTION

Thus, the present invention provides an improved combination of a container and an annular adapter or adapters which define an auxiliary storage space the adapter being operatively connectable to and removable from the upper beaded end of the container sidewall or to the upper end of an associated coacting adapter as the case may be. The adapter is made of a material having a memory, one end having a substantially identical shape to the upper beaded end of the container or associated adapter, and at the opposite end all means forms a connecting means or assembly having a sized cavity with a width slightly less than the thickness or width of the upper end of the container or associated adapter and further shaped with an internal groove positioned to match and mate with the said upper beaded end of the container or associated adapter, the adapter material being sufficiently deformable to enable the adapter to snap into assembled position to form a secure joint, and seal means in the connecting assembly provides a fluid tight joint when the adapter is in assembled position on the container or an associated adapter.

Additionally, the present invention covers an improved annular adapter for detachable connection to the upper beaded end of a container and other associated element for expanding the volumetric capacity of the storage space therein which includes, an annular wall means having an inner surface defining an auxiliary storage space, one end means on said annular wall means substantially identical to the upper beaded end of a container, means defining a connecting assembly at the other end of said annular wall means, said connecting assembly made of a material having a memory and including, a sized and shaped cavity, said connecting means deformable for matching and mating engagement with a corresponding beaded edge on an associated coacting container and the like so that the annular adapter can be operatively connected thereto, and seal means in the connecting assembly to form a fluid tight joint when the adapter is connected into assembled position on the associated connector and a like device.

Accordingly, it is an object of the present invention to provide an improved container of a standard size and an adapter or adapters which can be operatively connected to change or modify the size and volumetric capacity of the container.

It is another object of the present invention to provide a combination of a container and an adapter or adapters which can be operatively connected to change or modify the size and volumetric capacity of the container in which the adapter or adapters are provided with connecting means made of a material having a memory to permit the connecting means to deform and securely grasp the upper end of the container in assembled positions thereon.

It is another object of the present invention to provide for a container, an adapter or adapters which can be connected to the upper end or the rim of the container to effect a change or modification of the size and volumetric capacity thereof.

It is another object of the present invention to provide the combination of a container and an adapter or adapters for effecting change in the volumetric capacity wherein a simple and easily formed fluid tight joint between these elements is established.

It is another object of the present invention to provide an adapter for operative association with the upper end or the rim of a container manufactured in a standard size, to increase the volumetric capacity, which adapter can be easily removed when it is desirable or necessary to reduce the volumetric capacity back to the original standard size at which the container was manufactured.

These and other objects, advantages and ancillary features of the invention will become apparent from the following description of preferred embodiments of the invention and the appended claims when taken with the illustration thereof in the accompany drawings wherein:

DESCRIPTION OF A FIRST EMBODIMENT

Figure 2:
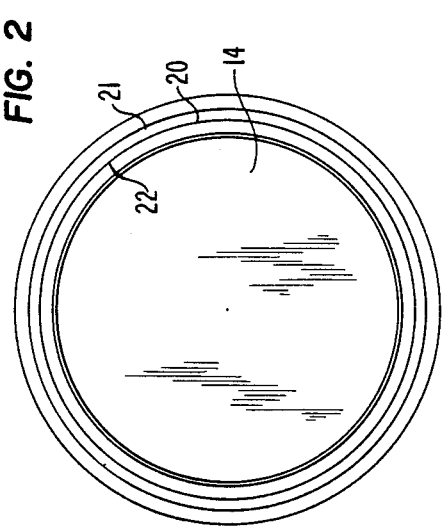
FIG. 2 is a top plan view of the container and adapter shown in FIG. 1, with the cover removed.
Figure 3:
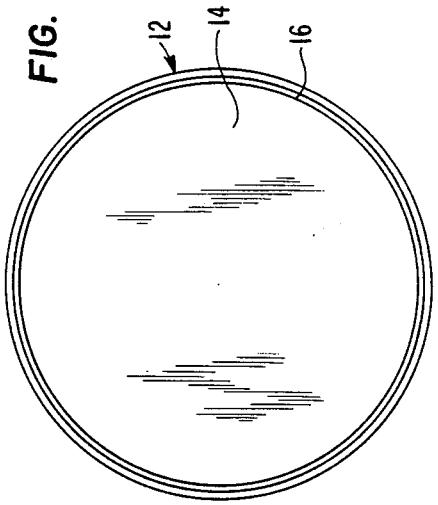
FIG. 3 is a bottom plan view of the container and adapter shown in FIG. 1.
Figure 1:
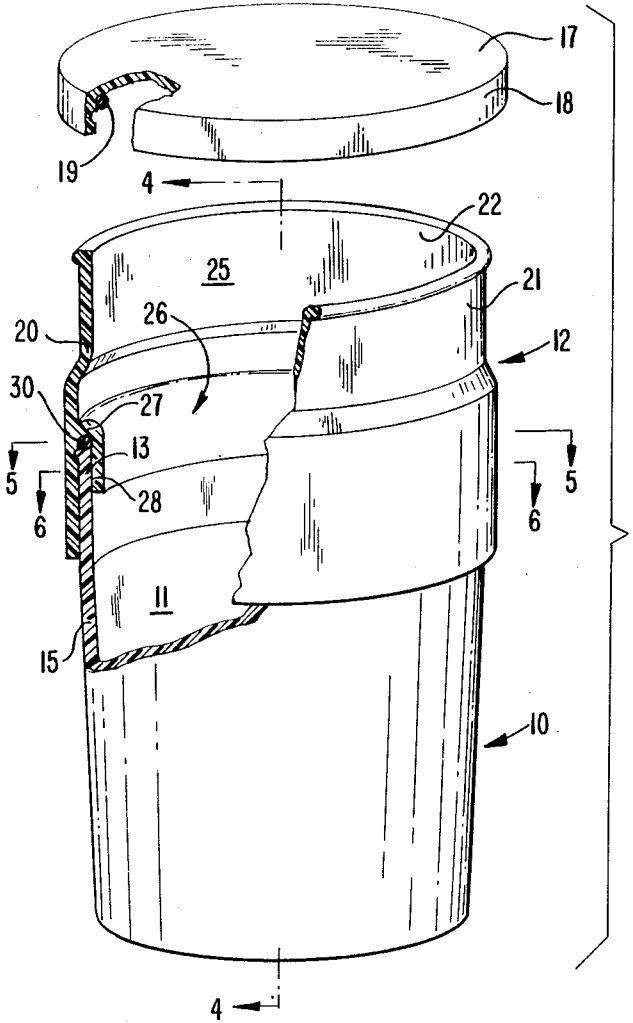
FIG. 1 is a side elevational view of one form of container having a single adapter thereon in accordance with the present invention for expanding the volumetric capacity of the container partly broken in vertical section away.

Referring to the drawings FIGS. 1 to 8 show one form of container generally designated 10 with a defined storage space 11 formed therein, having an annular adapter 12 mounted about the upper end or rim 13 of the container 10 to change or modify the volumetric capacity of the storage space and the size of the container all in accordance with the present invention.

While the container 10 is illustrated as having a generally cylindrical shape those skilled in the art will readily recognize that the container may have any desired shape or size to provide storage space for material in a desired volumetric capacity. Further to facilitate manufacture and to reduce costs, manufacturers select the desired shape and will establish sizes that the .given shape will provide so that a series of standard size containers can be manufactured. For example, it is common in the trade to make containers having volumetric capacities of one and one-half gallons, three gallons, five gallons, and ten gallons.

The problem which the present invention seeks to overcome is the instance where a customer requires or orders containers in sizes different from the generally standard sizes and volumetric capacities which are offered by the manufacturer.

In the present invention the problem is overcome by offering the container with an adapter 12, that is, a device so sized that when affixed to the upper beaded end or rim 13 of the container the volumetric capacity of the container will be expanded in terms of the additional or auxiliary space that is added to the storage space by the adapter 12 so that the storage space formed by the combination of the container with the adapter thereon consists of the standard storage space of a given volumetric capacity plus the additional volumetric capacity provided by the adapter 12 when it is in assembled position as will now be described.

Thus, referring to FIGS. 1 to 8 the container 10 is shown generally cylindrical in plan view with a bottom 14 and an annular sidewall 15. Annular sidewall 15 is connected about one end 16 to the bottom 14 to define the storage space 11 for the material to be placed in the container 10. The upper edge or rim 13 at the end of the annular sidewall 15 remote from the end connected to the bottom 14 forms the mouth or open end for providing access to the storage space 11. Since it is costly to form the annular sidewall 15 of the container with a thickness to protect the container from failure or other problems about the upper end or rim 13 which defines the mouth or open end of the storage space, it is conventional practice in the manufacture of containers to strengthen the upper end or rim 13 by providing a rolled or formed bead as at 13A. This rolled or formed bead 13A is advantageously utilized in the present invention so that the adapter can be so formed that it will coact with both the upper end or rim 13 and the bead 13A of the container to establish a secure connection when adapter 12 is connected into assembled position on the upper end or rim 13 of the coacting container whose volumetric capacity is being expanded.

Containers of a type to which the present invention is particularly applicable are formed or fabricated by known manufacturing techniques from high density materials such as polyethylene, polypropylene, and for special applications certain filled plastics, and certain metal alloys.

In the conventional container 10 with a standard size storage space the upper edge or rim 15 is adapted to receive or be fitted with a cover 17 having an annular flange 18 and inner gasket 19 so that in assembled position the cover will act to seal the storage space 11 in the container.

The annular adapter 12 is shaped and sized to fit about and onto the upper beaded edge or rim 13 of the container 10. The shape of the adapter 12 will depend on the shape of the upper beaded edge or rim 13 of the container 10 to which it must be matched and mated and on which it must be mounted in assembled position.

Adapter 12 may be fabricated by any well known manufacturing techniques such as the injection molding of high density plastic materials or other plastics and metal alloys which provide the required physical properties to permit deformation of the adapter when it is matched and mated to the upper beaded edge or rim 13 of the container 10 to enlarge the volumetric capacity thereof or to an associated adapter where two or more adapters are utilized for this purpose.

Thus, adapter 12 is made of any suitable material which provides at least the following two physical characteristics. First, the material for the adapter must have a memory, that is, when the adapter is subjected to manual or other forces which distort or deform the shape and size of the adapter, then when the forces are relieved, the adapter if free and not restrained or constrained due to engagement with the container as hereinafter described will return to its original shape and size, and after it is properly cleaned, sterilized and the like can be reused. Second, the material for the adapter is preferably inert with respect to the ingredients placed, poured or stored in the associated container to which the adapter is affixed.

In this regard, plastic material such as polyethylene, polypropylene, certain filled polytetrafluoroethylene, and some metal alloys are particularly suited for the objects and purposes of the adapters in accordance with the present invention.

Since, the methods of manufacture are well known and hence not more fully described herein they can be used to provide the desired shape and size form for the adapter 12, as to the limiting dimensions and structure more particularly for the connecting assembly as will now be more fully described.

Now referring to FIGS. 4, 5, 6 and 7, adapter 12 is shown as having an annular wall 20 which has an outer surface 21, an inner surface 22, and oppositely spaced ends as at 23 and 24 which define a chamber or auxiliary storage space 25 open at the respective opposite ends.

An inverted J-shaped annular skirt 26 having, a curved connecting section 27 and a depending planar or straight section 28 is disposed so that the curved section 27 is so connected to or formed on the inner surface 22 of annular wall 20 of the adapter 12 that the inverted J-shaped annular skirt 26 lies a predetermined medial distance between the oppositely spaced ends 23 and 24. The inverted J-shaped annular skirt 26 is so positioned that the adapter 12 when in assembled position on the container 10 will provide the desired increase in the volumetric capacity of the storage space 11 in the container.

When the inverted J-shaped annular skirt 26 is formed or connected to the inner surface 22 of the annular wall 20, the planar or straight section 28 will preferably not extend to the adjacent end 24 of the annular wall and will be spaced from the inner surface 22 to form a sized and shaped connecting space or pocket 29. By reference to FIGS. 1, 4, 7, 8 and 12 the connecting space 29 is shown as having a groove 29A which is so positioned that it will match and mate with the bead 13A about the upper end or rim 13 of the container 10 or an associated adapter where the bead is shown at 23A about the end 23 at FIG. 7 of the drawings.

The planar or straight section 28 will be generally parallel to or converge towards the inner surface 22 and the connecting space or pocket 29 is so sized that the annular adapter 12 can be friction fitted onto and about the upper beaded edge or rim 13 of the container 10, to form a connecting joint, all of which is shown in FIGS. 4, 7, 8 and 12 of the drawings.

FIGS. 4, 7, 8 and 12 also show that an O-ring 30 is disposed in the connecting space or pocket 29. Thus, when the adapter 12 is snapped onto the upper edge or rim 13 of the container 10, the O-ring will act to provide a seal and thus form a fluid tight connecting joint.

Since the material from which the adapter 12 or the inverted J-shaped skirt 26 is formed will have a memory, as was above described, and therefore be sufficiently deformable or resilient, the dimension of the connecting space 29 can be fixed to provide the desired friction fit for assembling the adapter 12 on the upper end 13 of the container 10. This is established by the dashed and solid lines at FIG. 7 of the drawings, the dashed lines being the original shape of the connecting shape or pocket 29 and the solid lines showing the deformed or distorted inverted J-shaped skirt 26 in friction fit engagement with the inner wall of the upper beaded end or rim 13 of the container 12.

Figure 7:
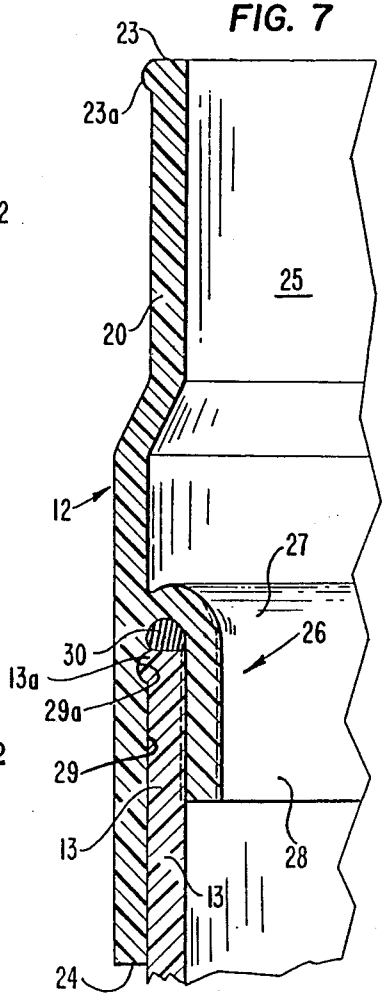
FIG. 7 is an enlarged fragmentary crosssection of the joint formed between the container and the adapter shown in FIG. 1, showing in dotted lines the original shape of the connecting means and in solid lines the deformation to form the joint.
Figure 5:
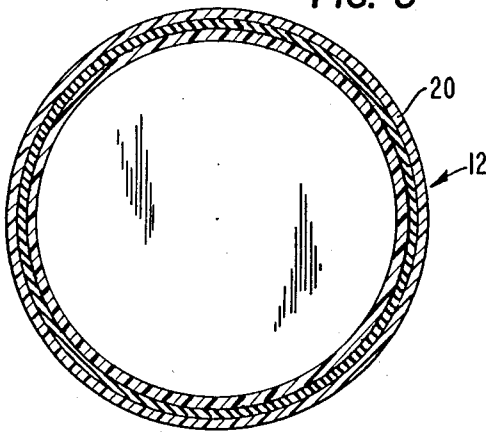
FIG. 5 is a horizontal cross-section taken on line 5—5 of FIG. 1.
Figure 6:
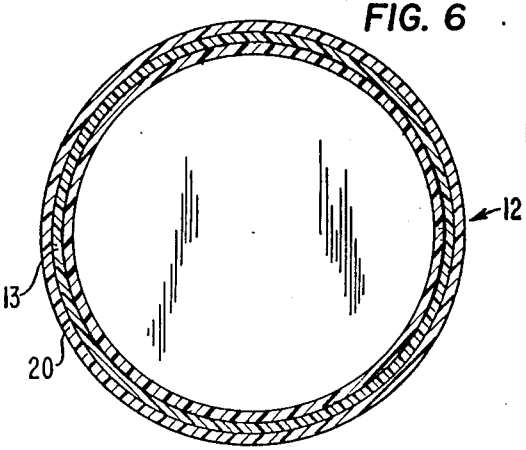
FIG. 6 is a horizontal cross-section taken on line 6—6 of FIG. 1.
Figure 4:
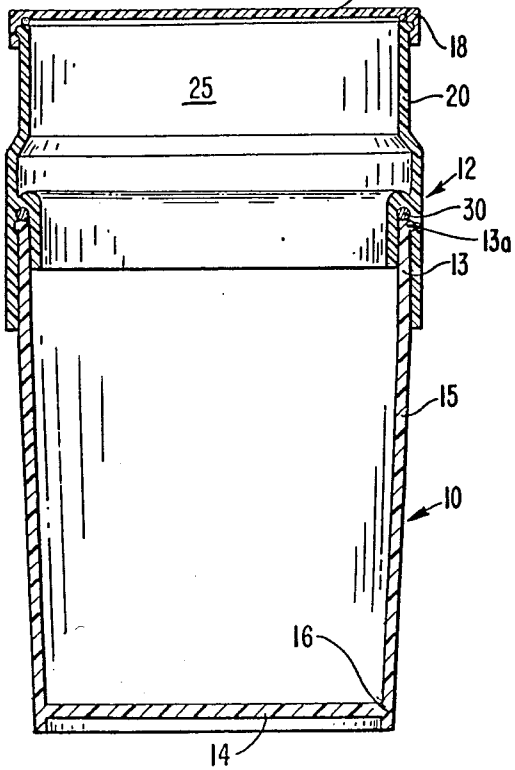
FIG. 4 is a vertical cross-section taken on line 4—4 of FIG. 1.
Figure 9:
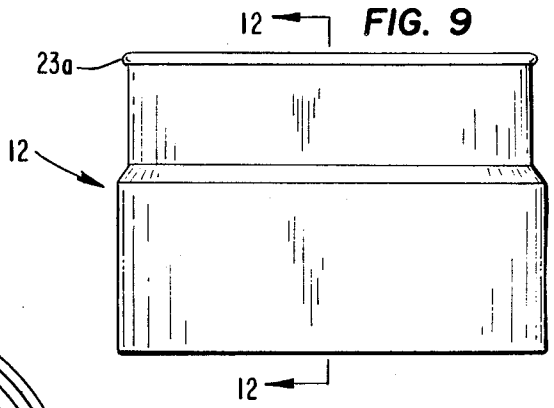
FIG. 9 is a side elevational view of the adapter in the form of the invention shown in FIG. 1.
Figure 11:
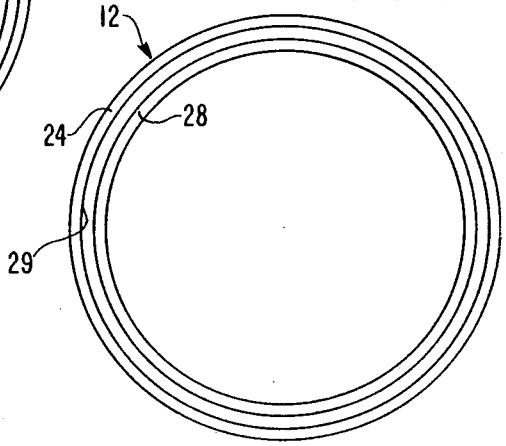
FIG. 11 is a bottom plan view of the adapter shown in FIG. 9.
Figure 10:
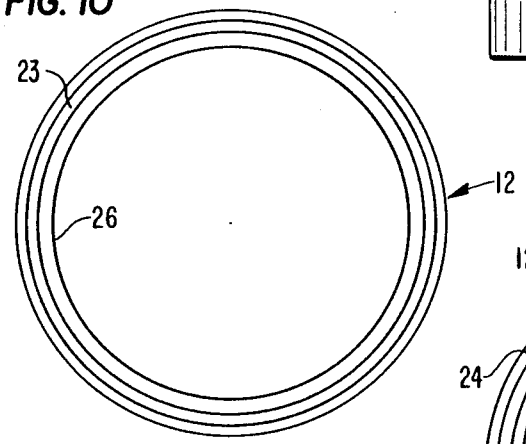
FIG. 10 is a top plan view of the adapter shown in FIG. 9.
Figure 8:
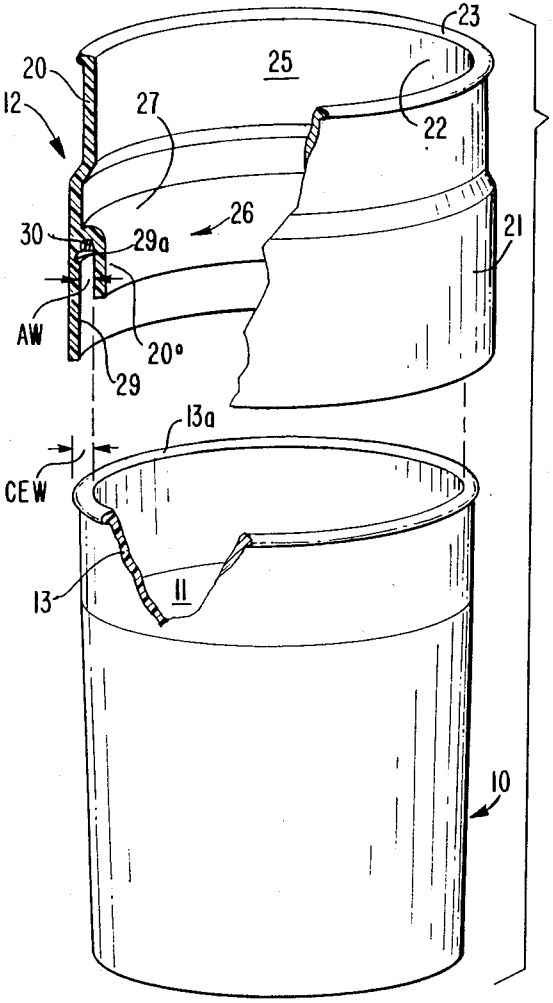
FIG. 8 is an exploded view of the container and adapter shown in FIG. 1 partly broken away in vertical section.
Figure 12:
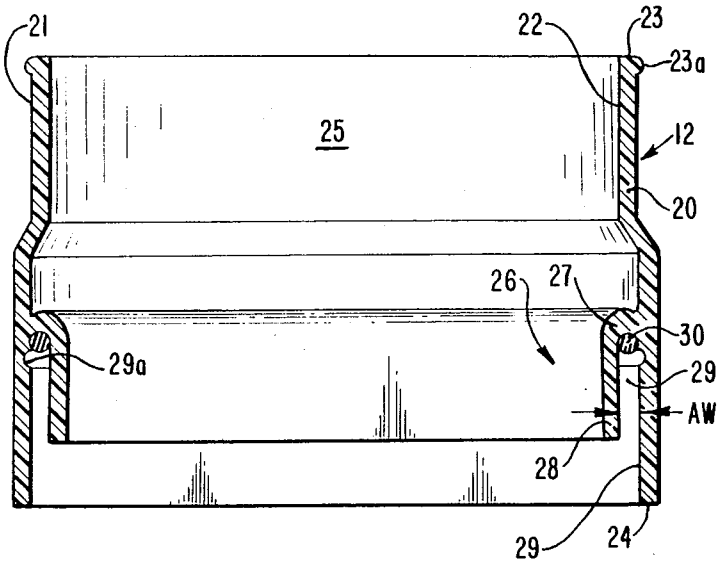
FIG. 12 is an enlarged vertical section of the adapter taken .on line 12—12 of FIG. 9.

Preferably, as shown at FIGS. 7, 8 and 12, the width AW of the connecting space 29 will be 1/32"±, 1/64", less than the width CEW of the upper end 13 of the container 10, all of which is shown in FIGS. 8 and 12.

Thus, as shown at FIG. 7, when the adapter 12 is connected to the upper beaded end 13 of the container 10, by manual or other forces, the inverted J-shaped skirt 26 will deform away from the annular wall 20 of the adapter 12 and in assembled position establishes a compression force which acts at the joint found between these elements thus tending to hold them firmly together in assembled positions.

The upper end 13 and the bead 13A of the container 10 will be forced into the connecting space 29 into contact with the O-ring seal 30 to make the joint fluid tight.

Those skilled in the art will readily recognize that other types of O-ring seals can be utilized to provide this fluid tight joint such as an O-ring fixed by some form of suitable groove in the sidewall of annular wall 20, not shown, and the inner face of the annular inverted J-shaped skirt 26, also not shown.

It is also thought clear that the dimension of the width at the upper end of the annular wall 20 will conform to the width CEW of the upper end 13 of the container 10 so that the same friction fit is established when adapters are connected to each other.

The shape, size and volumetric capacity for the auxiliary storage space 25 defined by the adapter 12 can be fixed or predetermined by providing an annular wall having a given height or length for the diameter of the adapter. Thus, the height or length times the diameter of the portion of the auxiliary storage space 25 for the adapter selected which extends above the storage space 11 of the container 10, when the adapter 12 is in assembled position on the container, will serve to expand the volumetric capacity of the storage space 11 as may be required.

By establishing adapters of various sizes such as a half gallon adapter, a one and one-half gallon adapter, and a two gallon adapter any standard sized container can be easily modified to provide volumetric capacities which are intermediate the standard size containers.

FIGS. 1 to 8 of the drawings show the form of the present invention in which only a single adapter is connected to the upper edge or rim 13 of the container 10. The adapters in accordance with the present invention are so formed or constructed that they can be connected to each other because the upper end, as at 23, of each respective adapter will have the same shape, form, and width as the upper edge or rim 13 and bead 13A of the container 10, thus enabling each of the adapters to form a connecting joint with another adapter so that conjoint adapters of at least two or more can provide various means for expanding the volumetric capacity of the container 10 as may be required to meet commercial requirements for a given order from a customer, as will now be described.

ANOTHER EMBODIMENT OF THE INVENTION

Figure 14:
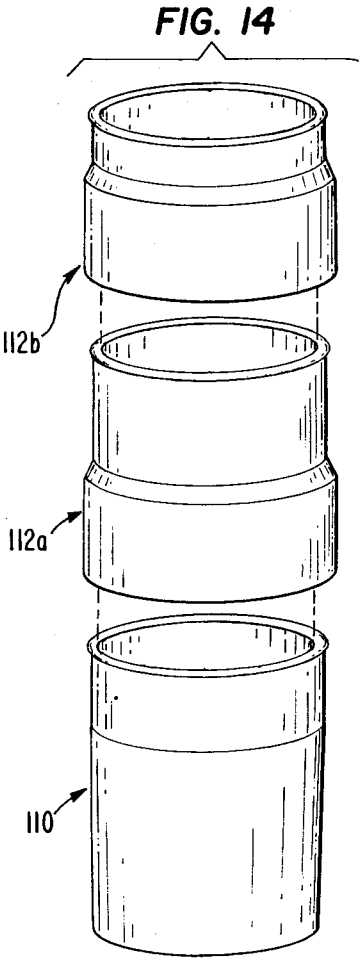
FIG. 14 is an exploded view of the form of the invention shown in FIG. 14.
Figure 13:
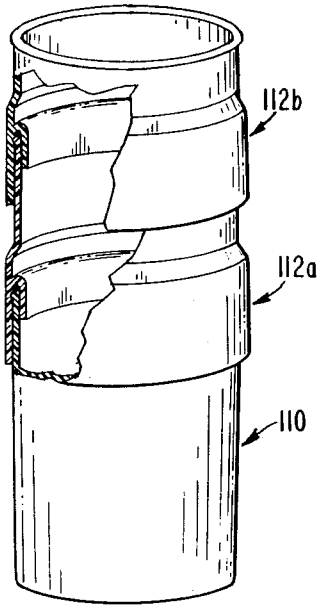
FIG. 13 is a side elevational view of another form of the invention showing the container and two operatively associated adapters of different sizes connected sequentially in assembled position, without the cover.

FIGS. 13 and 14 show a further embodiment of the invention in which the container 110 having the usual standard storage space 111 is combined with two adapters as at **112*a* and 112*b***.

The adapter **112*a* and 112*b* are identical with the adapter 12** as above described.

In this form of the invention adapter **112*a* is first operatively and detachably connected to the upper end of the container 110. Since the upper end of the adapter 112 is identical to the upper end of the container 110, the said adapter 112*b* can be operatively and detachably connected to the upper end of the adapter 112*a* to further expand the storage space 111 for the container 110**.

In this illustrated form of the invention two different sized adapters are illustrated. It will be clear that any combination of sized adapters may be used to expand the volumetric capacity of the storage space in the container as may be required.

While the foregoing description illustrates various preferred embodiments of the device in accordance with the present invention, it will be appreciated that certain changes and modifications may be made in the structure of these disclosed arrangements without departing from the spirit and scope of the invention and that the same is defined by the claims as hereinafter set forth.

What is claimed is:

1. The combination of a container having a standard size storage space for material defined by a bottom, sidewall means connected at one end to the bottom, and an annular bead on an upper end of said sidewall means for remote from the bottom, with an adapter means operatively and detachably connectable to said upper end of the sidewall means to increase the volumetric capacity of the storage space in the container a predetermined amount, said adapter means including, a. at least one shaped and sized annular member having outer wall means and inner wall means defining an auxiliary storage space of predetermined volumetric capacity, b. said annular member having a first edge forming a first opening at one end in communication with the auxiliary storage spaced, and a second edge remote from said first edge, c. an inverted J-shaped skirt made of a material having a memory, connected at one end medially along the inner wall means of said annular member longitudinally inward of said first edge to define therewith a connecting space, and having a second end which extends to a point longitudinally inwardly of said second edge of said annular member, d. said connecting space between the inner wall means and the inverted J-shaped skirt having a width which is less than the width of said upper end of the sidewall means of the container, e. seal means in said connecting space proximate to said first end of said inverted J-shaped skirt operative to form a fluid-tight joint when said adapter means is assembled on the container, and f. an annular groove formed on said inner wall of said annular member below said seal means for mating engagement with said annular bead on said container to hold the adapter in assembled position to the upper end of the sidewall means of the container and to permit release of the annular member from assembled position on the container as may be required during use thereof.

2. The combination as claimed in claim 1 wherein the width of the connecting space is approximately 1/32" less than the width of the upper end of the sidewall means of the container.

3. The combination as claimed in claim 1 wherein, a. the material from which said inverted J-shaped skirt is made is a plastic from the group including, polyethylene and polypropylene, and b. the width of said connecting space is approximately 1/32" less than the width of the upper end of the sidewall means of the container.

4. An adapter means for expanding the volumetric capacity of the standard storage space in a container having an annular bead on an upper end which forms an opening about the storage space comprising, a. a shaped annular member sized to fit about the upper end of the container, b. said annular member having an outer wall, an inner wall defining an auxiliary storage space of predetermined volumetric capacity, a first edge forming a first opening at one end in communication with the auxiliary storage space, and a second edge remote from said first edge, c. an inverted J-shaped skirt made of a material having a memory, connected at one end medially along the inner wall means of said annular wall member longitudinally inward of said first edge to define therewith a connecting space, and having an second end which extends to a point longitudinally inward of said second edge of said annular member, d. said connecting space between the inner wall means and the inverted J-shaped skirt having a width which is less than the width of said upper end of the sidewall means of the container, e. seal means in said connecting space proximate to said first end of said inverted J-shaped skirt operative to form a fluid-tight joint when said adapter means is assembled on the container, and f. an annular groove formed on said inner wall of said annular member below said seal means for sliding engagement with said annular bead on said container to hold the adapter in assembled position to the upper end of the sidewall means of the container and to permit release of the annular member from assembled position on the container as may be required during use thereof.

5. In the adapter as claimed in claim 4 wherein the width of the connecting space is approximately 1/32" less than the width of the upper end of the sidewall means of the container.

6. In the adapter as claimed in claim 4 wherein, a. the material from which the connecting means is made is a plastic from the group including, polyethylene and polypropylene, and b. the width of the connecting space is approximately 1/32" less than the width of the upper end of the sidewall means of the container.

* * * * *

UNITED STATES PATENT AND TRADEMARK OFFICE

CERTIFICATE OF CORRECTION

PATENT NO. : 4,852,757

DATED : August 1, 1989

INVENTOR(S) : Milton Gold

It is certified that error appears in the above-identified patent and that said Letters Patent is hereby corrected as shown below:

Column 1, line 7, "ore" should read --more--.

Column 7, line 68, "material" should read --materials--.

Column 8, line 2, "of" should read --on--.

Column 8, line 14, "spaced" should read --space--.

Signed and Sealed this

Nineteenth Day of June, 1990

*Attest:*

HARRY F. MANBECK, JR.

*Attesting Officer*

*Commissioner of Patents and Trademarks*